United States Patent [19]

Taquino

[11] Patent Number: 4,607,586

[45] Date of Patent: Aug. 26, 1986

[54] PRELOADED COMPRESSION ABSORBER CELL FOR BOAT BUMPERS

[76] Inventor: Weldon P. Taquino, 202 N. Locksley Dr., Lafayette, La. 70503

[21] Appl. No.: 715,649

[22] Filed: Mar. 25, 1985

[51] Int. Cl.[4] ..... B63B 59/02

[52] U.S. Cl. ..... 114/219; 405/212

[58] Field of Search ..... 114/219, 220; 405/212, 405/213, 214, 215; 267/139, 140

[56] References Cited

U.S. PATENT DOCUMENTS

| | | | |
|---|---|---|---|
| 2,413,210 | 12/1946 | Blackman | 114/219 |
| 2,424,635 | 7/1947 | Schwall | 114/219 |
| 2,952,979 | 9/1960 | Rolando | 114/220 |
| 2,997,325 | 8/1961 | Peterson | 114/219 |
| 3,005,435 | 10/1961 | Roach | 114/220 |
| 3,404,534 | 10/1968 | Cunney | 114/219 |
| 3,564,858 | 2/1971 | Pogonowski | 114/219 |
| 3,718,326 | 2/1973 | Ristau | 114/219 |
| 4,109,474 | 8/1978 | Files et al. | 114/219 |
| 4,293,241 | 10/1981 | Helveston et al. | 114/219 |
| 4,311,412 | 1/1982 | Guilbeau | 114/219 |
| 4,363,474 | 12/1982 | LeBlanc et al. | 114/219 |
| 4,408,931 | 10/1983 | LeBlanc et al. | 114/219 |
| 4,477,302 | 10/1984 | LeBlanc | 156/165 |

*Primary Examiner*—Trygve M. Blix
*Assistant Examiner*—Stephen P. Avila
*Attorney, Agent, or Firm*—Pravel, Gambrell, Hewitt & Kimball

[57] ABSTRACT

A compression shock absorber for use on offshore oil platforms, for example, is used as part of an overall bumper system for receiving impact from marine vessels which are docking at the offshore platform. The apparatus includes a base structural section which is preferably horizontally disposed and having one end portion that is rigidly attached to the offshore oil platform at one of the legs near the water line. A moving structural section slides upon the first base structural section between inner retracted and outer projected positions. The sections are preferably cylindrical such as structural steel pipe, for example. First and second load transfer surfaces are carried respectively by the base and by the moving structural sections for transferring a compressive load between the base and structural sections during use and at rest. A compressible mass such as resilient rubber is positioned between the first and second load transfer surfaces for biasing the moving section into the projected position. A tensioning bar normally puts the mass in compression and defines the projected position as a normal resting position prior to impact by a vessel. Thus, the mass can always be maintained in compression, increasing the shear component load which the device can handle.

10 Claims, 4 Drawing Figures

PRELOADED COMPRESSION ABSORBER CELL FOR BOAT BUMPERS

BACKGROUND OF THE INVENTION

The present invention relates to marine vessel bumper systems for use on stationary offshore platforms such as oil rigs and the like as protection against damage from collisions by boats, barges, and like marine vessels. More particularly, the present invention relates to an improved, resiliently supported vessel bumper system for offshore marine platforms and the like.

There are a large number of stationary oil and gas drilling platforms and production platforms located in coastal and offshore areas. For example, the oil and gas fields off the coasts of Louisiana, Texas and California are filled with hundreds of stationary platforms that are used to drill for oil and gas, or to produce oil and gas after drilling is completed. Many of these structures are enormous in size and very expensive to construct and to install. Some such fixed platforms are located in water which is hundreds of feet deep. Offshore oil platforms normally use a very large base called a "jacket" which is manufactured on land of welded structural tubing or pipe. The jacket will consist typically of four or more generally vertical legs which extend the full length of the jacket from the seabed to the water surface and a desired distance above the water surface. The legs are usually slanted a small number of degrees with respect to the water surface so as to maintain structural integrity with regard to the forces of wind and wave. It has been known to affix boat bumpers or bumper assemblies at the water line for the purpose of cushioning the impact of vessel, barge or the like which approaches the offshore platform. Such bumpers protect the legs and other structural parts of the jacket from damage. It should be understood that damage such as denting of the structural portions of the rig can cause severe damage to the structural integrity of the entire drilling rig or production platform. Thus, there is a need to provide a bumper system which will prevent direct impact or collision between a barge, vessel, or other boat and the leg portion of the jacket or subsea template.

A number of devices have been patented directed to the problem of providing a bumper assembly or a shock absorber for offshore platforms. For example, the Files, et al. U.S. Pat. No. 4,109,474 entitled "Bumper Assembly Shock Cell System" provides a boat bumper system for fending off vessels which are traveling adjacent fixed platform structures such as offshore oil and gas well drilling rigs, or offshore production platforms. The Files device relates to the use of a pair of cylindrical telescoping members which are joined together by a rubber sleeve or body which is adhered to the inner surface of a larger cylinder and to the outer surface of a smaller inner cylinder so that the inner cylinder can telescope with respect to the outer cylinder. The annular rubber cylinder is bonded with glue, for example, to the inner surface of the outer cylinder and to the outer surface of the inner cylinder. A stop plate is secured inside the outer cylinder and spaced inwardly from the end of the inner cylinder a distance slightly greater than the thickness of the annular rubber body so that the plate will shear loose from the outer cylinder to permit travel of the inner cylinder beyond normal limits only in response to extreme forces. In such a case of extreme forces, the rubber shock cell would fail and tear away from either the inner or outer cylinder.

Another glued or bonded system which is similar to the Files bumper assembly shock cell system is seen in U.S. Pat. No. 4,363,474 entitled "Anti Pullout Bumper." That devices uses a similar construction to the Files device in that inner and outer metal pipe members are joined at their ends by a rubber sleeve-like body between the outer end of the outer pipe member and the inner end of the inner pipe member. A flexible snub device is used to telescopically limit the distance that the inner and outer metal pipe members can move apart with respect to each other thereby defining a predetermined snub distance which prevents further movement of the inner pipe member out of the outer pipe member.

Various other devices have been patented directed to the use of various bumper systems on offshore platform legs. Note, for example, the Blackman, U.S. Pat. Nos. 2,413,210, the Rolando 2,952,979, the Roach 3,005,435, and Schwall 2,424,635.

A system that uses cylindrical but vertically rather than horizontally disposed shock cells can be seen in the Gilbeaux U.S. Pat. No. 4,311,412. That device includes an apparatus for attachment to an offshore platform which provides shock absorbing elements having an eccentric design.

Other patents which show rubber resilient members that are bonded or glued to telescoping pipe members can be seen in U.S. Pat. Nos. 4,408,931 and 4,477,302.

The above devices which use chemical bonding and/or glue suffer because when the telescoping members are pulled apart, the rubber shock cell member fails and tears, destroying the utility of the entire device until it can be replaced. Many of the above listed patents specifically disclose such a "tearing" of the rubber as a desirable situation when extremely high loads are encountered. Notice, for example, the Files patent which uses a shearable stop plate which prevents excessive movement of the moving telescoping member and thus prevents rupture of the rubber sleeve that joins the two telescoping member, unless a very large load is incurred. With excessive loads, the stop plate shears under such as extreme load which also destroys the rubber shock cell. A similar fate befalls the rubber cell which is a part of the Teledyne U.S. Pat. No. 4,363,474 entitled "Anti Pullout Bumper." Excessive load causes the flexible snub member to fail so that the rubber sleeve-like body is destroyed thus preventing destruction to the rig itself. In such cases, replacement of the bumper assembly is expensive and time-consuming. Such bonded systems do provide some resistance to shear or sideways loads such as when a tug or boat smashes the bumper from the side.

SUMMARY OF THE INVENTION

The present invention solves these prior art problems and shortcomings by providing an improved bumper system for use on offshore platforms and rigs which has increased shear resistance and which does not require destruction of the rubber resilient "shock" portion of the device when the device is pulled apart under excessive load. The apparatus of the present invention includes a base structural section such as a tubular section of pipe or structural steel tubing which has one end portion that is normally attached to the offshore oil platform by welding, bolting, or other such suitable means. A moving structural section slides upon the first section between a projected "normal" position and a compressed, retracted position. First and second load transfer surfaces are carried respectively by the base section and moving section for transferring a compressive load between the base and structural sections. A compressible mass such as a resilient rubber cell is positioned between the first and second load transfer surfaces for urging the moving section into the projected position. However, a tensioning bar normally "preloads" the mass (i.e., puts the mass in compression), and also defines a normal resting position prior to impact by a marine vessel. Thus, the mass can apply an initial compressive load to the load transfer surfaces prior to marine vessel impact which gives pre-stressed, positive load components that aid against shear and diagonal loads such as imparted by vessels which strike the apparatus from the side.

In the preferred embodiment, the first and second load transfer surfaces are first and second transverse plates which are affixed respectively to the base structural section and the moving structural section.

The tensioning means is preferably an elongated tensile bar which joins the first and second plates when they are in the projected position. Compression by a marine vessel against the moving structural section causes further compression of the resilient mass which is usually and preferably preloaded with a compression value. If excessive tensile force is applied to the moving structural section, it will part from its connection with the base structural section because one or both of the transverse plates will fail, allowing the base and moving structural sections to separate. Because the compressible mass is not bonded, glued, or otherwise used to join the base structural section and moving structural section in the preferred embodiment, no damage whatsoever is imparted to the compressible mass during such a tensile failure. Rather, the device can be put reassembled using the same rubber cell. The resilient rubber-like shock cell is not destroyed or otherwise harmed.

A void space surrounds the compressible shock cell mass with sufficient volume so that the compressible mass can expand to completely fill the void space in the retracted position. When the apparatus is forced into the retracted position however, the space enlarges (see FIG. 4 of the drawings).

BRIEF DESCRIPTION OF THE DRAWINGS

A better understanding of the invention can be had when the detailed description of a preferred embodiment set forth below is considered in conjunction with the drawings, in which.

DETAILED DESCRIPTION OF THE PREFERRED EMBODIMENT

Figure 1:
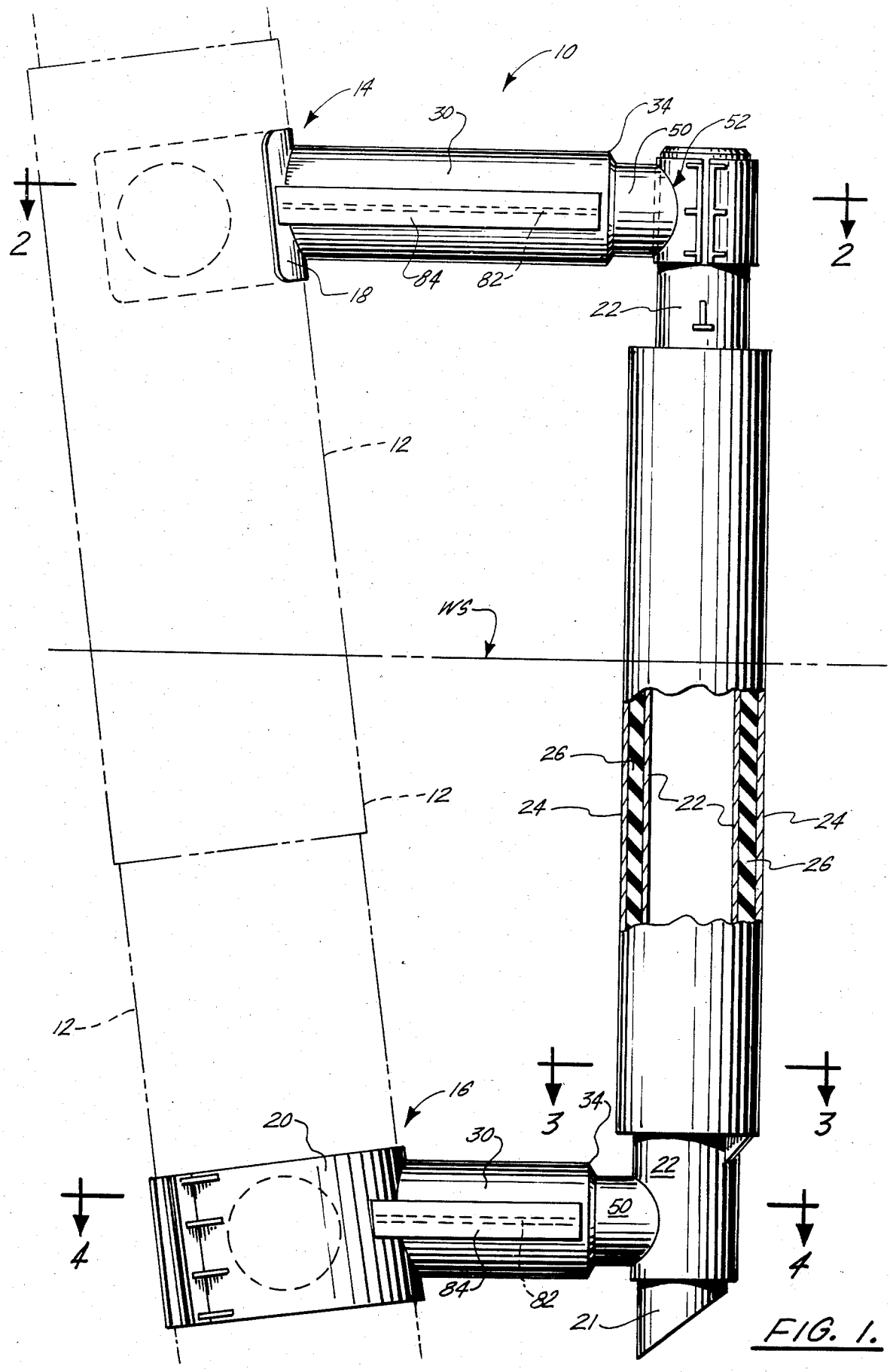
FIG. 1 is an elevational view of the preferred embodiment of the apparatus of the present invention.

The present invention is designated generally by the numeral 10 in FIG. 1. Compression absorber cell 10 includes an apparatus which can be attached, for example, to a jacket leg 12 of an offshore oil rig or platform. Jacket leg 12 can be generally vertical, or can have an inclination of a few degrees with respect to the water surface WS as shown in FIG. 1. It should be understood that multiple jacket legs 12 are usually provided on a typical offshore oil platform. For example, four (4) or eight (8) legs 12 may be provided on a typical offshore oil or gas drilling rig or fixed production platform. However, any number of legs could be provided on very large rigs.

An upper mounting position 14 and a lower mounting position 16 are shown in FIG. 1 with upper position 14 being occupied by upper mounting plate 18. Lower position 16 is correspondingly provided with lower mounting plate 20. Mounting plates 18, 20 are preferably arcuate or annular structures which conform to the outside surface of jacket leg 12. Mountint plates 18, 20 can be welded, bolted or otherwise structurally affixed to jacket leg 12 so that a firm connection is formed between leg 12 and base structural member 30 of shock absorber cell assembly 10. Base structural member 30 is preferably cylindrical, but could be another similar tubular structural shape.

A vertical bumper member 22 is shown in FIG. 1 as surrounded by a protective sleeve 24 within which is seen a mass of resilient bumper material 26 which is annular in construction. Vertical bumper 22 is spaced from leg 12 by a pair of shock absorber cells 10 (FIG. 1). Bumper 22 is closed at the bottom with end cap 21 that prevents sale water intrusion.

Base member 30 affixes to leg 12 by welding, bolting or the like. Member 30 has a hollow bore 31 and an open end portion 34 which allows centralizing sleeve 40 to be positioned between the inside end portion 34 of base member 30 and sliding member 50. Centralizing sleeve 40 is a rubber sleeve bonded only to inner member 50. Sleeve 40 centralizes moving member 50 within the bore 31 of base structural member 30 and also absorbs energy from lateral bonds. However, the centralizing sleeve 40 slides with inner moving member 50. Sliding member 50 connects to vertical bumper 22 at 52. A load transfer plate 36 is transversely connected to the inside bore 31 of member 30. A corresponding load transfer plate 54 is affixed to the inside bore 51 of moving member 50. A space 62 is thus defined between load transfer plates 36 and 54. The space 62 is occupied by a rubber-like compressible load cell 60 which is preferably cylindrical, having a central bore 64 that allows tension rod member 70 to pass through the bore. Each plate 36, 54 has an opening that allows tension rod 70 to pass through it. The rod 70 can slide freely with respect to either plate 36, 54 but has enlarged ends 72, 74 that hold the plates 36, 54 a distance apart that defines the projected position of the member 60 with respect to the member 30. The cell 60 can be longer in length than the distance between plates 36, 54 so that the cell is prestressed in the normal resting position, placing the cell in compression and thus prestressing the plates 36, 54 with a preload. This preload gives the cell 10 extra strength to withstand impact loads including lateral-diagonal loading. Impact upon vertical bumper 22 causes member 50 to retract into member 30, further compressing cell 60. If the members 30, 50 are pulled apart, one of the transverse plates 36, 54 will fail, preventing any further damage to apparatus 10 or the platform leg 12. Since cell 60 is not glued or otherwise bonded to member 30, it is not torn or destroyed by separation of members 30 and 50.

Figure 2:
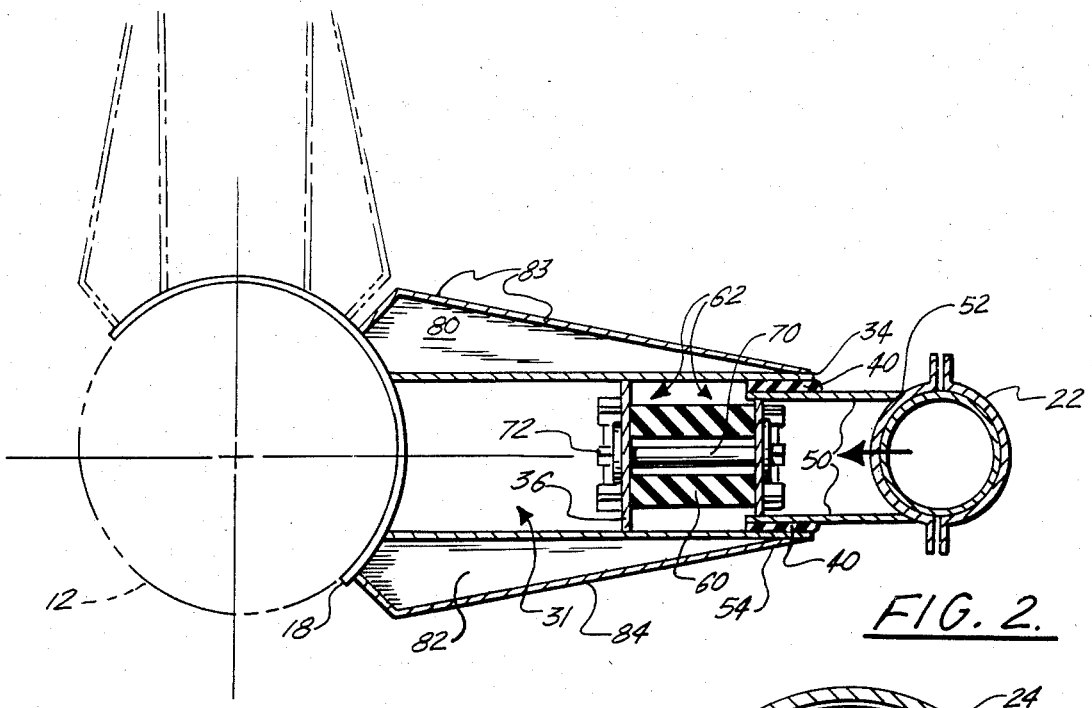
FIG. 2 is a sectional view taken along lines 2—2 of FIG. 1.
Figure 3:
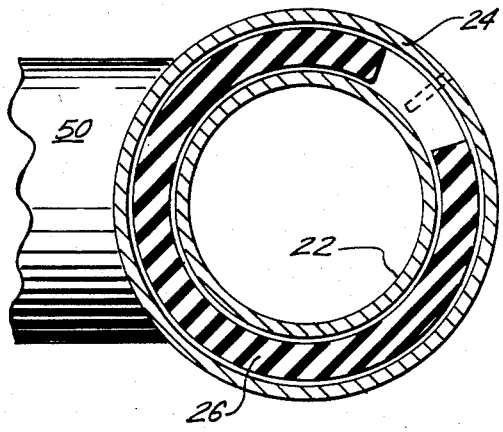
FIG. 3 is a sectional view taken along lines 3—3 of FIG. 1.
Figure 4:
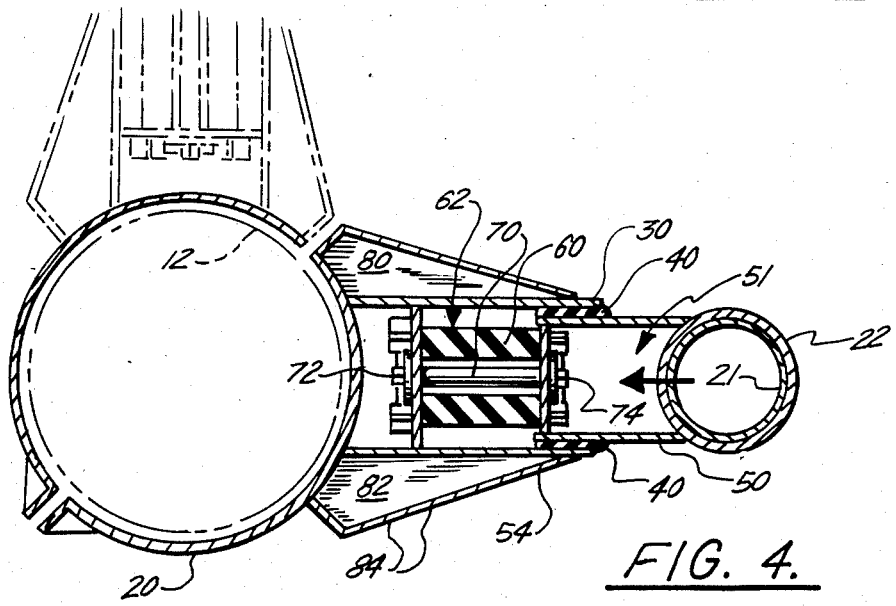
FIG. 4 is a sectional view taken along lines 4—4 of FIG. 1.

A plurality of stiffener plates 80, 82 extend from leg 12 substantially along the entire length of base structural member 30 (see FIG. 2). Stiffener plates 80, 82 are generally horizontally placed as can best be seen in FIG. 1. Each stiffener plate 80, 82 includes a peripheral web 83, 84 respectively which is connected perpendicularly to the generally horizontal plates 80, 82. Since no bonding of rubber has been made to the inside of base structural member 30, stiffeners 80, 82 can be welded the full length of outer base structural member 30 without damage to the rubber cell 60. The plates 80, 82 and webs 83, 84 provide reinforcement against lateral loads and shear. If rubber were bonded to the inside surface of base structural member 30, welding of stiffeners 80, 82 to the exterior surface of the base structural member 30 would produce excessive heat which would damage or destroy the bonding and/or the rubber.

The foregoing description of the invention is illustrative and explanatory thereof, and various changes in the size, shape and materials, as well as in the details of the illustrated construction may be made without departing from the spirit of the invention.

I claim:

1. A marine compression absorber for supporting bumpers on offshore platforms that can sustain impact from a moving marine vessel comprising:

a. a tubular base structural section having one end portion that is normally attached to an offshore oil platform and a central hollow bore;

b. a moving structural section that slides upon the base section in a telescoping fashion between inner retracted and outer projected positions;

c. first and second transverse load transfer surface means in the form of parallel plates carried respectively by the base and moving structural sections for transferring a compressive load between the base and structural sections;

d. a compressible rubber mass positioned between the first and second load transfer surfaces and surrounded by at least one of the structural sections, and an airspace which allows the rubber to laterally deform for biasing the moving section into the projected position;

e. tensioning means in the form of a tension rod forming a connection between the first and second load transfer surfaces in the projected rest positon to put the rubber mass in compression by holding the first and second load transfer surface means in a position that squeezes the compressible rubber mass therebetween, for defining the projected rest position as a normal resting position prior to impact by a marine vessel so that the rubber mass can apply a compressive load to the load transfer surfaces prior to marine vessel impact; and f. the tensioning means disconnecting from at least one of the load transfer surfaces when movement occurs to the retracted position.

2. The apparatus of claim 1, wherein the first and second load transfer surfaces are first and second plate members affixed respectively to the base and moving sections.

3. The apparatus of claim 1, wherein the base and moving section are tubular and the base section is of a larger diameter than the moving section.

4. The apparatus of claim 3, wherein the base section and moving sections are of corresponding cross-sectional configuration.

5. The apparatus of claim 1, wherein the moving structural section telescopes within the base structural section and the compressible mass means is positioned within the confines of the base structural section.

6. The apparatus of claim 1, wherein the compressible mass means is unattached to either the base structural section or the moving structural section so that when the two sections are separated, the compressible mass means can be freely removed.

7. The apparatus of claim 1, wherein the compressible mass means is a resilient rubber body removably mounted within the base structural section.

8. The apparatus of claim 1 further comprising shear resistant means disposed on the exterior surface of the base structural member for reinforcing the base structural member against shear loads applied to either the base structural member or the moving structural section.

9. The apparatus of claim 8, wherein the base reinforcement means includes one or more horizontally disposed gusset plates extending from the offshore rig platform to a position upon the base structural section.

10. The apparatus of claim 8, wherein the shear resistant means includes one or more extension lateral stiffener plates that extend the full length of the base structural member.

* * * * *